US007120584B2

(12) United States Patent
Sheikhzadeh-Nadjar et al.

(10) Patent No.: US 7,120,584 B2
(45) Date of Patent: Oct. 10, 2006

(54) METHOD AND SYSTEM FOR REAL TIME AUDIO SYNTHESIS

(75) Inventors: Hamid Sheikhzadeh-Nadjar, Waterloo (CA); Etienne Cornu, Cambridge (CA); Robert L. Brennan, Kitchener (CA)

(73) Assignee: AMI Semiconductor, Inc., Pocatello, ID (US)

( * ) Notice: Subject to any disclaimer, the term of this patent is extended or adjusted under 35 U.S.C. 154(b) by 814 days.

(21) Appl. No.: 10/277,598

(22) Filed: Oct. 22, 2002

(65) Prior Publication Data

US 2003/0130848 A1 Jul. 10, 2003

(30) Foreign Application Priority Data

Oct. 22, 2001 (CA) ..... 2359771

(51) Int. Cl.
*G10L 13/08* (2006.01)

(52) U.S. Cl. ..... 704/266

(58) Field of Classification Search ..... None
See application file for complete search history.

(56) References Cited

U.S. PATENT DOCUMENTS 5,991,787 A * 11/1999 Abel et al. ..... 708/400
6,081,780 A * 6/2000 Lumelsky ..... 704/260
6,118,794 A * 9/2000 Cornfield et al. ..... 370/497
6,173,263 B1 * 1/2001 Conkie ..... 704/260

FOREIGN PATENT DOCUMENTS

EP 0813184 A1 12/1997
EP 1089258 A2 4/2001

OTHER PUBLICATIONS

Sheikhzadeh, Hamid et al.; "Real Time Speech Synthesis on an Ultra Low-Resource, Programmable DSP System"; Article; May 2002; Pages 433-436; vol. 1, 13-17; IEEE International Conference on Acoustics, Speech, and Signal Processing; Dspfactory, Ltd., Ontario, Canada; Orlando, Florida, USA.

Brennan, Robert et al.; An Ultra Low-power Miniature Speech CODEC at 8kb/s and 16 kb/s; Article; Oct. 16-19, 2000; Whole Document; Dspfactory. Ltd., Ontario, Canada; ICSPAT 2000 Proceedings; Dallas, Texas, USA.

* cited by examiner

*Primary Examiner*—Susan McFadden
(74) *Attorney, Agent, or Firm*—Gardner Groff Santos & Greenwald, PC

(57) ABSTRACT

A method and system for synthesizing audio speech is provided. A synthesis engine receives from a host, compressed and normalized speech units and prosodic information. The synthesis engine decompresses data and synthesizes audio signals. The synthesis engine can be implemented on a digital signal processing system which can meet requirements of low resources (i.e. low power consumption, lower memory usage), such as a DSP system including an input/output module, a WOLA filterbank and a DSP core that operate in parallel.

50 Claims, 12 Drawing Sheets

FIG. 4A FRAME 302

FIG. 4B FRAME 304

FIG. 4C PREDICTION ERROR 350

FIG. 4D DIFFERENCE FUNCTION 320 AND ITS ADPCM

TIME DOMAIN IMPLEMENTATION OF THE CS-PSOLA

FREQUENCY DOMAIN IMPLEMENTATION OF THE CS-PSOLA

METHOD AND SYSTEM FOR REAL TIME AUDIO SYNTHESIS

CROSS-REFERENCE TO RELATED APPLICATION

This application claims priority under 35 U.S.C. §119 to a Canadian Patent Application entitled, "Method and System for Real-Time Audio Synthesis," having Ser. No. 2,359,771, filed Oct. 22, 2001, which is entirely incorporated herein by reference.

FIELD OF THE INVENTION

The invention relates to synthesis of audio sounds, and more particularly to a method and a system for text to speech synthesis substantially in real time.

BACKGROUND AND ADVANTAGES OF THE INVENTION

There are various methods available to solve the speech synthesis problem in general. The most successful methods use an inventory of prerecorded speech units, such as diphones, and concatenate the units (with or without some prosodic modifications) to synthesize fluent speech with correct prosody. Prosody relates to the pitch, rhythm, stress, tempo and intonation used in expressing words i.e. how the words are spoken. Through employing unit selection methods described in U.S. Pat. No. 6,266,637, one can achieve a reasonable quality of synthesized speech and avoid the prosodic modification of speech units by recording a very large inventory of units and searching for optimal units to be concatenated at the synthesis stage.

However, these techniques require a large amount of volatile and nonvolatile memory to store the unit inventory, and search results. Also, the search for optimal units at the synthesis stage is complicated and increases the computation load significantly.

An alternative form of Text-to-Speech (TTS) synthesizers is the class of small-unit concatenation systems that use less than a few thousands of speech units. Amongst the various versions of these systems proposed in the literature, the Time-Domain Pitch-Synchronous Overlap and Add (TD-PSOLA) method is very simple and offers a reasonable speech quality if the problems of pitch, phase and spectral discontinuities are properly addressed. Details of TD-PSOLA is described in Diphone Synthesis Using an Overlap-Add Technique for Speech Waveforms Concatenation, F. Charpentier and M. G. Stella, Proceedings of the ICASSP, 1986 pp. 2015 to 2018 and Pitch-Synchronous Waveform Processing Techniques for Text-to-Speech Synthesis Using Diphones, E. Moulines, and F. Charpentier, Speech Communication, vol. 9, No. 5–6, 1990 and U.S. Pat. No. 5,369,730.

In PC-based synthesis systems, synthesized speech is stored in temporary files that are played back when a part of the text (such as a complete phrase, sentence or paragraph) has been processed. In contrast, in a typical real-time system, the text has to be processed while synthesis is taking place. Synthesis cannot be interrupted once it has started. Also, synthesis is not a straight-through process in which the input data can be simply synthesized as it is made available to the processor. The processor has to buffer enough data to account for variations in prosody. It also has to work on several frames at a time in order to perform interpolation between such frames while synthesis is taking place.

Therefore, it is desirable to provide a real-time audio synthesis method and system that offers a high quality audio in real-time, and that can meet requirements of low resource usages (i.e. lower memory usage, low power consumption, low computation load and complexity, low processing delay).

SUMMARY OF THE INVENTION

It is an object of the present invention to provide a novel method and system for text to speech synthesis in real-time, which obviates or mitigates at least one of the disadvantages of existing methods and systems.

In accordance with an aspect of the present invention, there is provided a system for synthesizing audio signals that receives the text as input, analyses the text to find the speech unit labels and prosody parameters to provide speech units which are possibly compressed and prosody scripts which are possibly compressed. The system includes a decompression module for decompressing speech units and prosody scripts and an overlap-add module for synthesizing speech using the speech units based on the prosody scripts.

In accordance with a further aspect of the present invention, there is provided a system for processing speech units, which includes an off-line compression module for compressing re-harmonized speech units, and an on-line frequency-domain decompression module having an oversampled synthesis filterbank for decompressing the compressed speech units.

In accordance with a further aspect of the present invention, there is provided a system for synthesizing audio signal, which includes a decompression module for decompressing speech units and a circular shift pitch synchronous overlap-add (CS-PSOLA) module including a fixed-shift weighted overlap-add module for implementing a weighted overlap-add of the decompressed data. The speech unit includes a frame of a constant pitch period. The circular shift pitch synchronous overlap-add module shifts the frame so that two consecutive frames make a periodic signal with a desired pitch period.

In accordance with a further aspect of the present invention, there is provided a system for synthesizing audio signals, which includes an on-line processing module including an interface for interfacing a host to receive compressed speech units and related compressed prosody parameters, a decompression module for decompressing data received on the interface, and an overlap-add module for synthesizing speech units using the speech units based on the related prosody parameters. The receipt of data from the host, decompression and speech synthesis are carried out in parallel, substantially in real-time.

In accordance with a further aspect of the present invention, there is provided a system for speech unit re-harmonization, which includes an off-line module and an on-line module. The off-line module includes a normalizing module including a module for generating constant-pitch speech frames of more than one pitch period, a compression module for compressing the output of the normalizing module and a database for recording the output of the compression module. The on-line module includes an interface for interfacing the off-line module for receiving data from the database a decompression module for decompressing data received on the interface and a speech engine for synthesizing speech using the output of the decompression module.

In accordance with a further aspect of the present invention, there is provided a method of synthesizing audio signals on a system that receives the text as input, analyses the text to find the speech unit labels and prosody parameters to provide speech units which are possibly compressed and prosody scripts which are possibly compressed. The method includes the steps of decompressing speech units and prosody scripts and performing overlap-add synthesizing speech using the speech units based on the prosody scripts.

In accordance with a further aspect of the present invention, there is provided a method of synthesizing speech, which includes the steps of decompressing data regarding to speech units and implementing a circular shift pitch synchronous overlap-add (CS-PSOLA) The speech unit includes at least one frame of a constant pitch period. The CA-PSOLA step includes the step of a fixed-shift weighted overlap-adding to applying a weighted, overlap-add process to the decompressed data, the step of the CS-PSOLA shifting the frame so that two consecutive frames make a periodic signal with a desired pitch period.

Other aspects and features of the present invention will be readily apparent to those skilled in the art from a review of the following detailed description of preferred embodiments in conjunction with the accompanying drawings.

BRIEF DESCRIPTION OF THE DRAWINGS

The present invention will be further understood by the following description with reference to drawings in which.

DETAILED DESCRIPTION OF THE PREFERRED EMBODIMENTS

Figure 1:
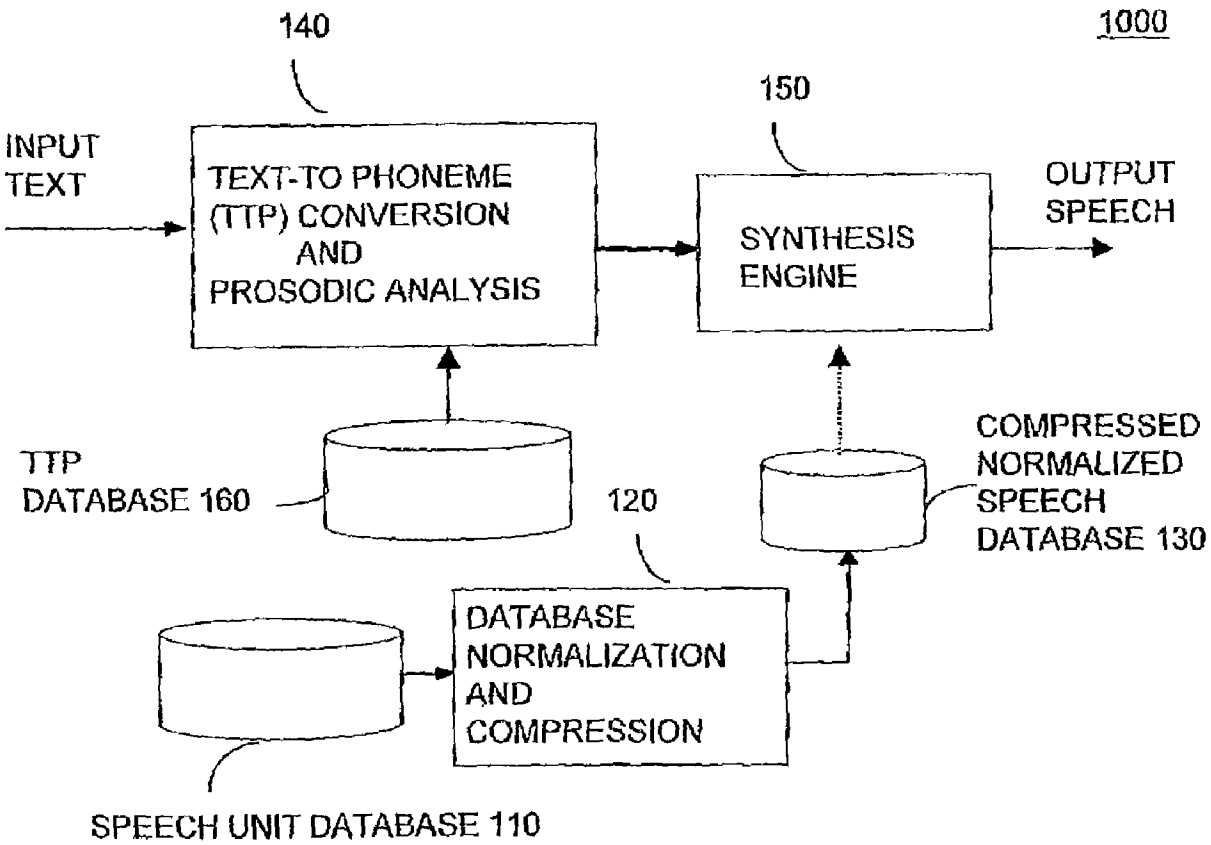
FIG. 1 is a block diagram showing a diphone-based concatenation system in accordance with an embodiment of the present invention.

FIG. 1 is a block diagram showing a diphone-based concatenation system 1000 in accordance with an embodiment of the present invention. The diphone-based concatenation system 1000 includes a speech unit database 110, a database normalization and compression module 120, a compressed-normalized speech database 130, a Text-To-Phoneme (TTP) conversion and prosodic analysis module 140, a TTP database 160 and a synthesis engine 150.

The speech unit database 110 (e.g. a diphone database) is first normalized to have a constant pitch frequency and a phase, and then compressed in the database normalization and compression module 120 to produce a compressed-normalized speech database 130. These processing steps are completed in advance, this is offline. An input text is supplied to the TTP conversion and prosodic analysis module 140. The TTP conversion and prosodic analysis module 140 converts the text into a sequence of diphone labels, and also calculates prosody parameters that control the speech pitch, loudness, and rate. The TTP conversion and prosodic analysis module 140 specifies the speech unit labels, and passes the speech unit labels together their related prosody parameters (pitch, duration, and loudness) to the synthesis engine 150. The TTP database 160 provides the relevant phoneme information to be used in the TTP conversion process. The prosody parameters may be compressed to occupy a few bytes per frame in the TTP conversion and prosodic analysis module 140.

Finally, the appropriate speech units are read from the compressed-normalized speech database 130 by the synthesis engine 150 and processed using the prosody parameters to form audio speech.

The speech units are computed and stored in the compressed-normalized speech database 130 in a time-domain form or in a frequency-domain form in the manner described below.

The compressed-normalized database 130 is derived from the database 110 using two techniques: speech normalization and compression. The speech unit database 110 is first processed offline to obtain a normalized database such that each speech unit has a nominal constant pitch frequency ($F0=1/T0$) and a phase that is substantially fixed, up to a cut-off frequency of less than 3 kHz. The normalization method may be any high-quality speech synthesis method that is capable of synthesizing a high quality speech at a constant pitch Examples include the Harmonic plus Noise Model (HNM) or the hybrid Harmonic/Stochastic model (H/S).

Using speech synthesis Systems such as the aforementioned Harmonic plus Noise Model (H NM) or the hybrid Harmonic/Stochastic model (H/S), the speech frames, each of around two pitch periods in duration, are first analyzed. Then, the constant-pitch and fixed-phase elementary waveforms are synthesized for each frame. The details of the HNM and H/S are described in On the Implementation of the Harmonic Plus Noise Model for Concatenative Speech Synthesis, Y. Stylianou, Proceedings of the ICASSP2000, pp. 957–960 and On the Use of Hybrid Harmonic/Stochastic Model For TTS Synthesis-by-Concatenation, Theirry Dutoit, and B. Gosselin, Speech Communication, 19, pp. 119–143.

The elementary waveform can have a length of one pitch period (T0) if the synthesized elementary waveforms are assumed to be perfectly periodic. However, for naturally uttered speech, the perfect periodicity assumption does not hold for almost all the unvoiced sounds, nor for many classes of voiced sounds, such as voiced fricatives, diphthongs, nor even for some vowels. This means that two consecutive pitch periods are not exactly the same for most voiced sounds. Thus, in accordance with the embodiment of the present invention, an elementary waveform is synthesized to have a length NÇT0 (T0 is one pitch period, N is an integer, N°2). In the following description, 2ÇT0 is exemplified as the length of the elementary waveform.

Figure 2:
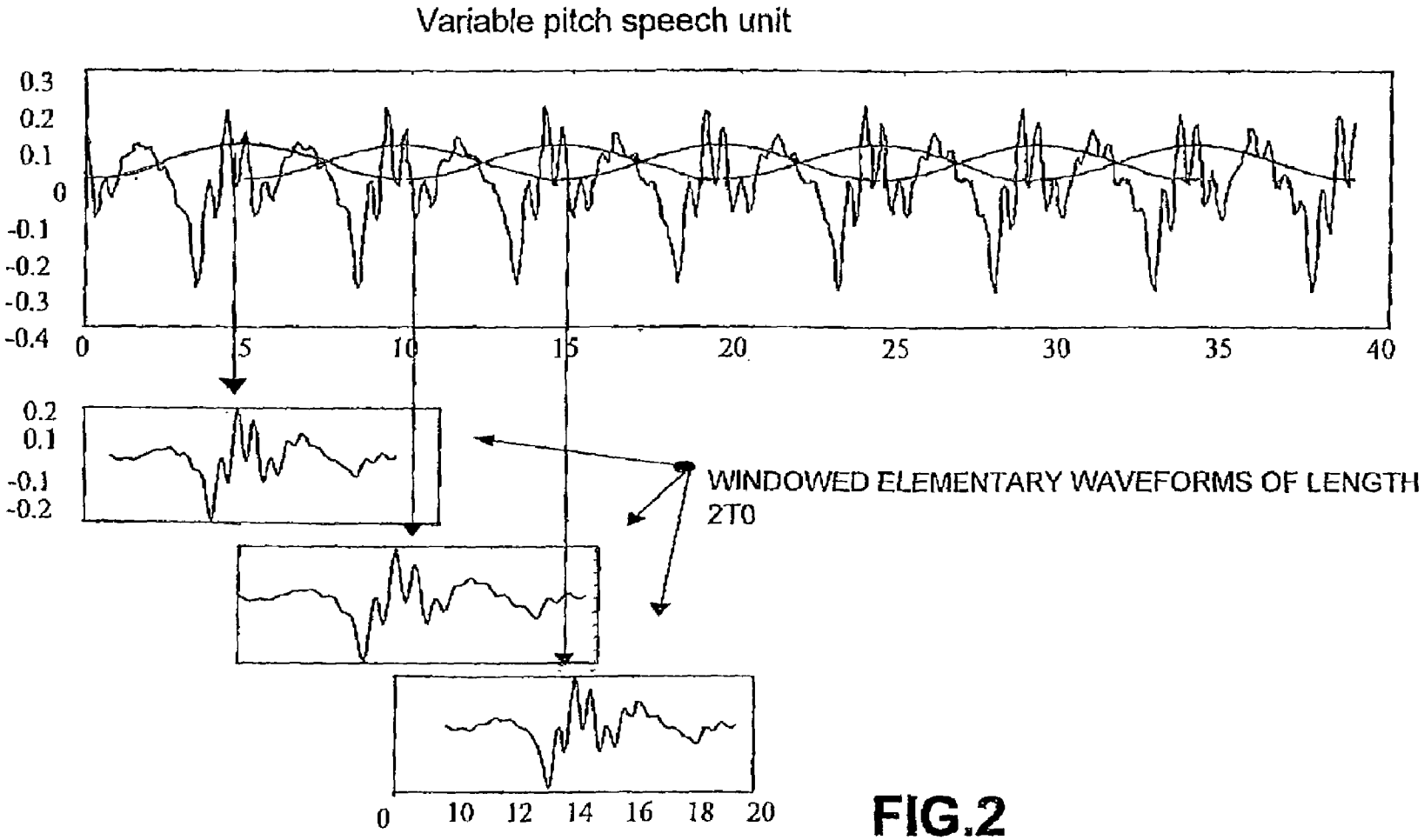
FIG. 2 is a timing diagram showing a variable pitch speech unit and windowed elementary waveforms.

FIG. 2 is a timing diagram showing a variable pitch speech unit and windowed elementary waveforms. As shown in FIG. 2, the elementary waveform is synthesized every pitch period, and multiplied by a Hanning window. Other similar and related window functions may also be used, (e.g. Hamming, Blackman). Then, an overlap-add (OLA) process is carried out to obtain a normalized speech waveform.

Referring to FIG. 1, the re-synthesized units, which are retrieved from the compressed-normalized database 130 based on the related prosody parameters, can be used for a time-domain concatenation without pitch and phase discontinuities. The spectral discontinuities are removed through a simple time-domain interpolation as described in MBR-PSOLA Text-to-Speech Synthesis Based On an MBE Re-Synthesis of the Segments Database, Theirry Dutoit, and H. Leich, Speech Communication, vol. 13, pp. 435–440, November 1993. The interpolation process is limited to the voiced sounds.

As a result of using synthesis models, such as the HNM, that are capable of modelling the speech time variations within a few pitch periods, the diphone-based concatenation system 1000 can ensure reasonable speech quality.

The re-synthesized units are compressed in the database normalization and compression module 120. Time-domain and frequency-domain compressions are described.

If the elementary waveforms were assumed to be one period long, there may be unavoidable discontinuities (at frame boundaries) in the compressed-normalized speech database 130 due to the frame-to-frame acoustic variations. However, when overlap-add (OLA) synthesis is employed to obtain normalized speech using elementary waveforms units, each of which has a length of N T0 (N°2), any jumps or discontinuities in the normalized units are removed or at least alleviated due to the OLA smoothing. As a result, the elementary waveforms units can be further compressed by adaptive-predictive methods.

The normalized speech units have the same pitch period (TO), and due to the phase normalization in the re-synthesis process, the consecutive frames are very similar, at least for the voiced sounds. A high-fidelity compression technique described below is used to reduce the size of the compressed-normalized speech database 130. The compression is based on exploiting both the frame-to-frame and within-the-frame correlation of the normalized speech.

The voiced/unvoiced status of the frames is accurately known. A variant of the classical Adaptive differential Pulse Code Modulation (ADPCM) carefully optimised to make use of the database features is employed. The objective is to achieve a high compression ratio while preserving the decoder simplicity. In view of the hardware structure, a decoder (i.e. a decompression module) employs only fixed-point additions and bit-shifting, with no multiplies or floating-point operations.

Figure 3:
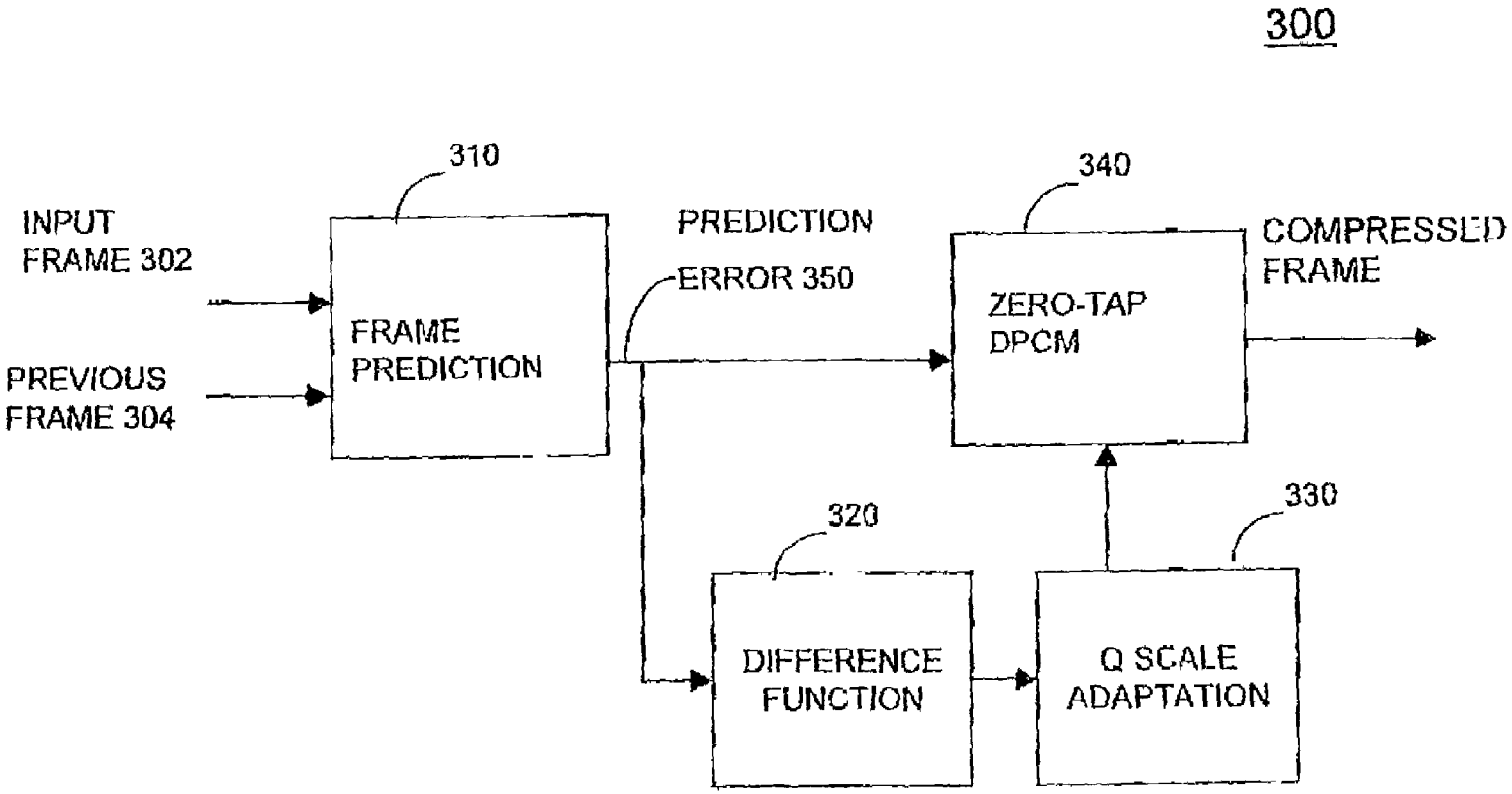
FIG. 3 is a block diagram showing one example of a compression module of FIG. 1.
Figure 4:
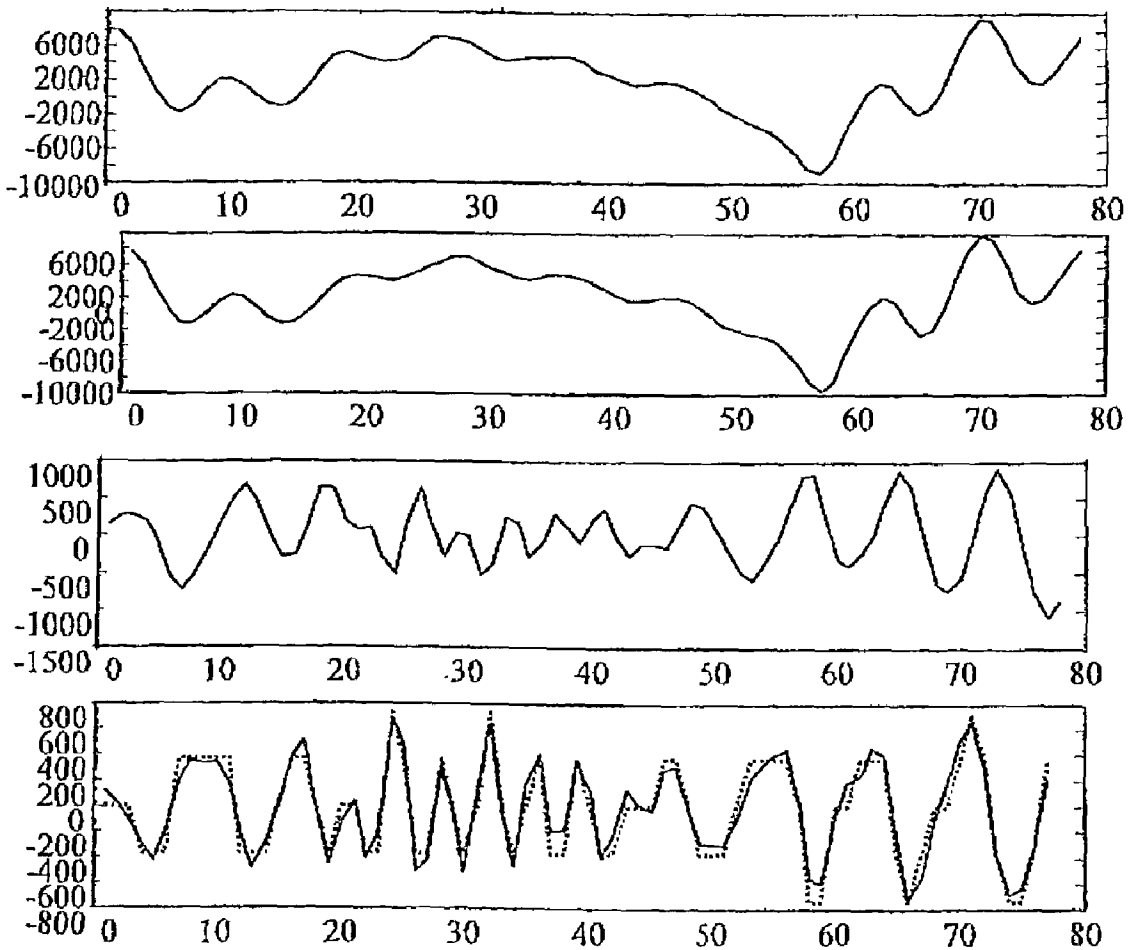
FIGS. 4A and 4B are timing diagrams showing examples of two consecutive sample input frames.
FIG. 4C is a timing diagram showing a prediction error 350 of the input frames of FIGS. 4A and 4B.
FIG. 4D is a timing diagram showing a result of a difference function and a ADPCM compressed signal of FIGS. 4A and 4B.

FIG. 3 is a block diagram showing one example of a compression module of the database normalization and compression module 120 of FIG. 1. FIGS. 4A to 4D are timing diagrams showing one example of the signals in the compression module 300 of FIG. 3. FIGS. 4A and 4B show two consecutive sample input frames 302 and 304. FIG. 4C shows a prediction error 350 of the input frames 302 and 304. FIG. 4D shows the result of a difference function 320 and an ADPCM compressed signal.

Referring to FIGS. 3 and 4A to 4D, the compression module 300 has a frame prediction module 310, a difference function module 320, a quantization (Q) scale adaptation module 330 and a zero-tap differential pulse code modulation (DPCM) module 340.

The frame prediction module 310 calculates a frame prediction error 350. For the voiced frames, the difference is calculated between the sample value 302 and the value 304 of the corresponding sample in the previous period. The difference is output as the frame prediction error 350.

For unvoiced sounds, the relevant frame of the speech waveform itself is output as the frame prediction error 350.

Since the consecutive frames are very similar for the voiced sounds, the frame prediction error 350 has a smaller dynamic range than the speech waveform itself. Further, the unvoiced sounds naturally have a smaller dynamic range than the voiced sounds. Therefore, the frame prediction error 350 generally has a smaller dynamic range than the input frames 302 and 304 for all sounds, The difference function module 320, the quantization scale adaptation module 330 and the zero-tap DPCM module 340 form a block-adaptive differential pulse code modulation (ADPCM) quantizer that is used to quantize the prediction error 350. A single quantization step D is adapted for each block (one pitch period) as follows.

Initially, the first-order difference function 320 of the prediction error 350 is calculated, and the maximum of its absolute value is found Based on this maximum value, the quantization step D is scaled (330) by a scale factor F for each period by the quantization scale adaptation module 330 so that there is essentially no data clipping in the quantization process. The frame prediction error 350 is scaled by the quantization scale, and then compressed with a zero-tap DPCM quantizer in the zero-tap DPCM module 340. For each frame, the ADPCM signal and the quantization scale are stored in the compressed-normalized speech database (130 of FIG. 1).

The scale factor F is constrained to be a power of two (i.e. $F=2^K$: K is an integer). As a result, at the decoding stage (i.e. decompression stage), the samples are simply scaled through being bit-shifted. It is not necessary to multiply/divide the samples.

Further examples of the data compression include advanced frequency-domain compression methods such as subband coding and one using an oversampled weighted overlap-add (WOLA) filterbank as described in An Ultra Low-Power Miniature Speech CODEC at 8 kb/s and 16 kb/s, R. Brennan et al., in Proceedings of the ICSPAT 2000, Dallas, Tex., which is incorporated herein by reference. The oversampled WOLA filterbank also offers efficient way to decompress speech frames compressed by such techniques. As described below, the oversampled WOLA filterbank includes an analysis filterbank and a WOLA synthesis filterbank. During decompression, the WOLA synthesis filterbank converts the speech unit data from the frequency domain back to the time-domain Frequency-domain compression can be optimised to take into consideration the constant-pitch nature of speech unit database. Also, a combination of time-domain and frequency-domain compression techniques is possible. While time-domain compression relies on the almost periodic time-structure of re-harmonized speech (especially in voiced segments), frequency-domain compression is justified due to spectral redundancies in speech signal.

The signal processing architecture is now described in further detail. The synthesis engine 150 of FIG. 1 is implemented on a digital signal processor (DSP). Any general purpose DSP modules suitable for use in low power systems may be used. It is preferable that the DSP module has efficient input/output processing, shared memory for internal communication for example, is programmable, and is capable of easy integration with the compressed-normalized speech database (130 of FIG. 1). The synthesis engine (150) working on a low-resource platform extends the range of applications for which speech synthesis technology is available.

Figure 5:
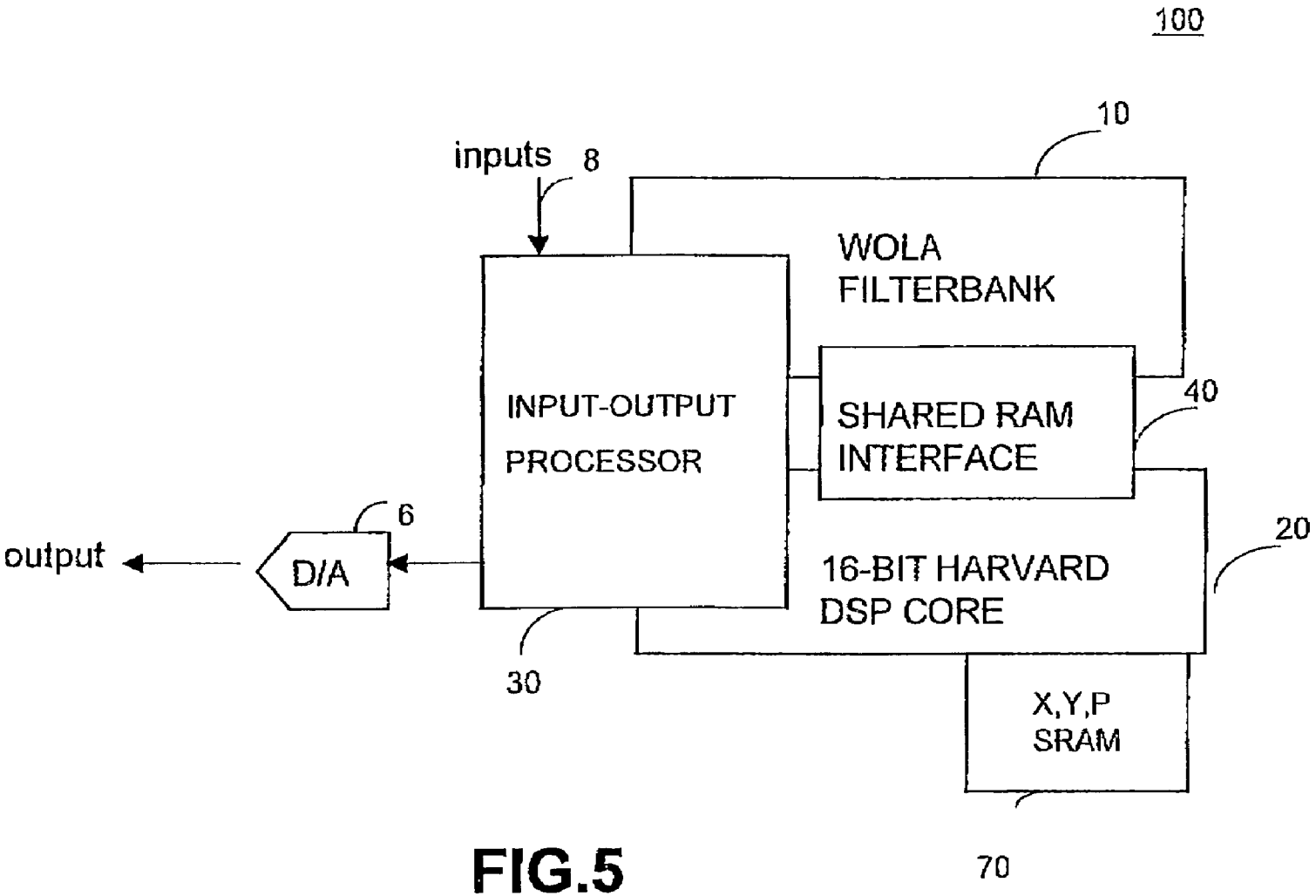
FIG. 5 is a block diagram showing one example of a platform of the synthesis engine.

FIG. 5 is a block diagram showing one example of a platform of the synthesis engine shown 150 in FIG. 1. The platform 100 of FIG. 5 (referred to as the DSP system 100 hereinafter) includes a weighted overlap-add (WOLA) filterbank 10, a DSP core 20, and an input-output processor (IOP) 30. The basic concept of the DSP system 100 is disclosed in U.S. Pat. No. 6,236,731 and No. 6,240,192B1 and A Flexible Filterbank Structure for Extensive Signal Manipulations in Digital Hearing Aids, R. Brennan and T. Schneider, Proc. IEEE int. Symp. Circuits and Systems, pp. 569–572. 1998, which are incorporated herein by reference.

The WOLA filterbank 10, the DSP core 20 and the input-output processor 30 operate in parallel. A digital chip on CMOS contains the DSP core 20, a shared Random Access Memory (RAM) 40, the WOLA filterbank 10 and the input-output processor 30.

The WOLA filterbank 10 is microcodeable and includes "time-window" microcode to permit efficient multiplication of a waveform by a time-domain window, a WOLA filterbank co-processor, and data memory. The WOLA filterbank may operate as the oversampled WOLA filterbank as described in U.S. Pat. No. 6,236,731 and U.S. Pat. No. 6,240,192B2, which are incorporated herein by reference. Audio synthesis in oversampled filterbanks is applicable in a wide range of technology areas including Text-to-Speech (TTS) systems and music synthesizers.

Figure 12:
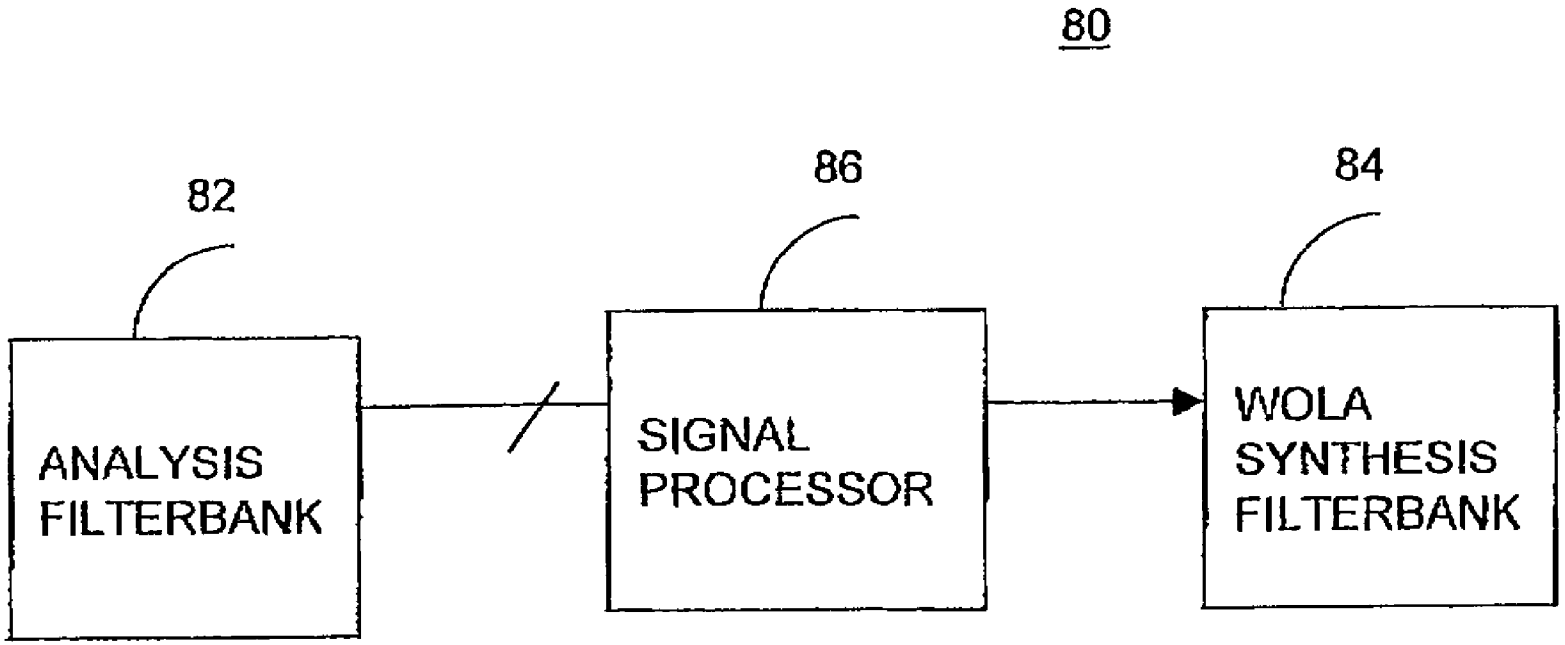
FIG. 12 is a block diagram showing one example of an over-sampled weighted overlap-add filterbank

FIG. 12 shows one example of the oversampled WOLA filterbank. As shown in FIG. 12, the oversampled WOLA filterbank 80 includes an analysis filterbank 82 for applying an analysis window in the time-domain and modulating the frequency response of the analysis window by the FFT to transform information signal in time-domain into a plurality of channel signals in frequency-domain, a WOLA synthesis filterbank 84 for synthesizing the time-domain signal from the channel signals, and a signal processor 86 to apply various signal processings to the channel signals. The individual channel signals are decimated by N/OS where N is the FFT size and OS is the oversampling factor. The decimated frequency signals are adjusted by applying suitable gains to them by the signal processor 86. Other signal processing strategies can also be applied by the signal processor 86 In the WOLA synthesis filterbank, inverse FFT, interpolation, synthesis window weighting and overlap-add process are applied.

Referring to FIG. 5, the programmable DSP core 20 enables it to implement time-domain algorithms that are not directly implementable by the WOLA co-processor of the WOLA filterbank 10. This adds a degree of reconfigurability.

The input-output processor 30 is responsible for transferring and buffering incoming and outgoing data. The data read from the TTP conversion and prosodic analysis module (140 of FIG. 1) and from the compressed-normalized speech database (130 of FIG. 1) may be buffered and be supplied to the input-output processor 30 through a path 8. The input-output processor 30 may also receive information from analog/digital (A/D) converter (not shown). The output of the input-output processor is supplied to a digital/analog (D/A) converter 6.

The RAM 40 includes two data regions for storing data of the WOLA filterbank 10 and the DSP core 20, and a program memory area for the DSP core 20. Additional shared memory (not shown) for the WOLA filterbank 10 and the input-output processor 30 is also provided which obviates the necessity of transferring data among the WOLA filterbank 10, the DSP core 20 and the input-output processor 30.

The DSP system 100 receives text input from the TTP conversion and prosodic analysis module (140 of FIG. 1) in the form of labels and the related prosody parameters through a shared buffer arrangement. A digital/analog converter 6 converts the output of the input-output processor 30 to an analog audio signal.

The synthesis engine (150 of FIG. 1) implemented on the DSP system 100 is particularly useful in environments where power consumption must be reduced to a minimum or where an embedded processor in a portable system does not have the capabilities to synthesize speech. For example, it can be used in a personal digital assistant (PDA) where low-resource speech synthesis can be implemented in an efficient manner by sharing the processing with the main processor. The DSP system 100 can also be used in conjunction with a micro-controller in embedded systems.

Front-end and back-end architecture are further described in further detail. The diphone-based concatenation system 1000 of FIG. 1 includes a front-end processor running on a host system and a back-end processor including the DSP system (100 of FIG. 5).

Referring to FIG. 1, the front-end processor including the TTP and prosodic analysis module 140 takes the text to synthesize as input from a user. The front-end first converts the text into a sequence of diphone labels and calculates for each a number of prosody parameters that control the speech pitch and rate. The front-end processor (140) then passes the diphone labels to the synthesis engine 150 on the DSP system (100) along with their related prosody parameters.

The back-end processor including the synthesis engine 150 performs on-line processing. The synthesis engine 150 extracts diphones from a database (e.g. the compressed-normalized speech database 130) based on the diphone labels The diphones are defined by the labels that give the address of the entry in the database (e.g. 130).

The synthesis engine 150 decompresses (possibly compressed) data related to the diphone labels and generates the final synthesized output as specified by the related prosody parameters. The synthesis engine 150 also decompresses (possibly compressed) prosody parameters.

Time-domain speech synthesis is described in further detail. The time-domain synthesizer (e.g. 702 to 710 of FIG. 7 as described below) of the synthesis engine (150) receives the normalized unit including constant pitch and phase frames of two pitch periods (elementary waveforms), applies the proper prosodic normalization (pitch, duration and amplitude variations), and concatenates the units to make words and sentences. The prosodic normalization is done in the DSP core (20 of FIG. 5). It applies the prosodic data to the speech units. The pitch, loudness and duration of the speech unit may be changed. All the operations are done on the elementary waveforms and in the time-domain.

Figure 6:
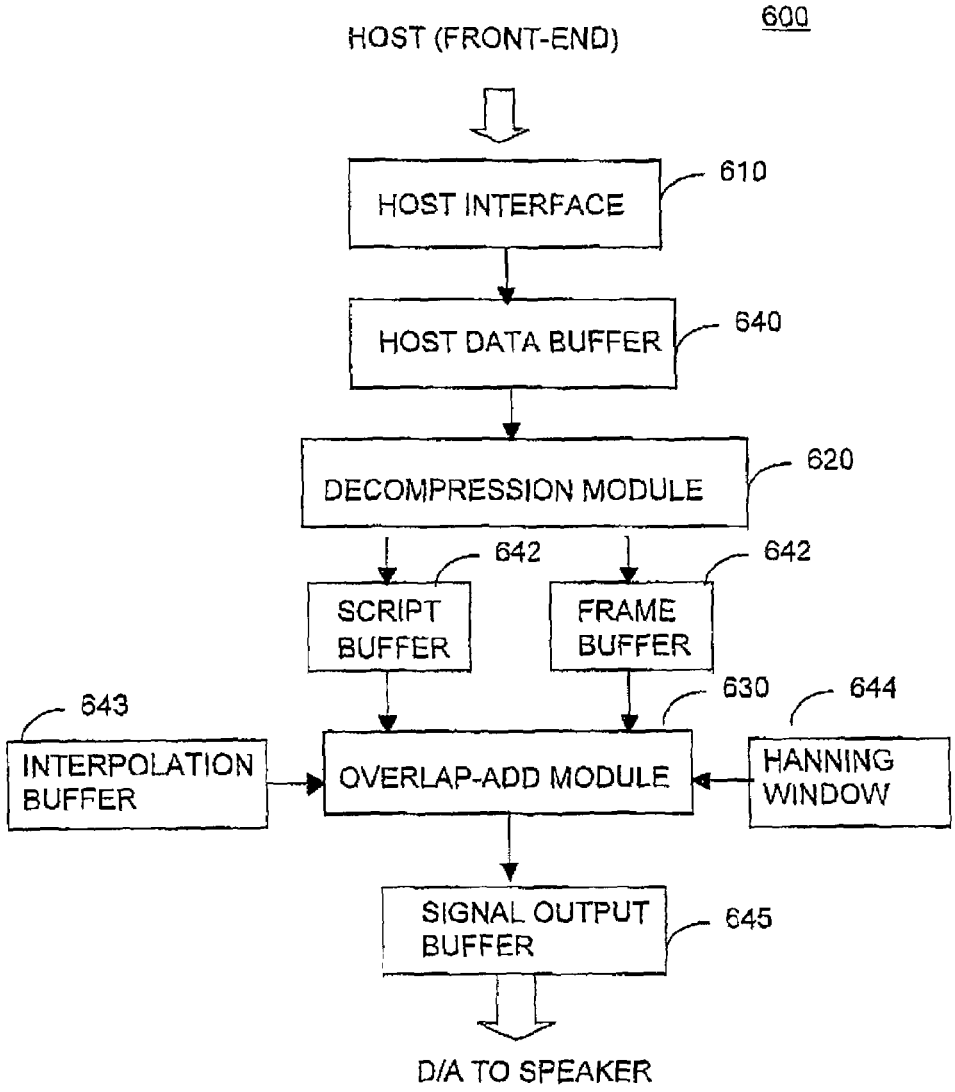
FIG. 6 is a block diagram showing one example of a synthesis system of the synthesis engine of FIG. 1.

FIG. 6 is a block diagram showing one example of a synthesis system of the synthesis engine. The synthesis system 600 is provided within the synthesis engine 150 of FIG. 1. The synthesis system 600 includes a host interface 610, a data decompression module 620, and an overlap-add module 630.

The synthesis system 600 further includes a host data buffer 640 for storing the output of the host interface 610, a script buffer 641 for storing a script output from the decompression module 620, a frame buffer 642 for storing a frame output from the decompression module 620, an interpolation buffer 643, a Hanning (or equivalent) window 644 and a signal output buffer 645.

When the synthesis system 600 is implemented on the DSP system 100 of FIG. 5, the host interface 610, the decompression module 620 and the overlap-add module 630 run on the DSP core (20). The host data buffer 640, the script buffer 641, the frame buffer 642, the interpolation buffer 643, the Hanning (or equivalent) window 644 and the signal output buffer 645 reside in the X, Y and P SRAM (70). The input-output processor (30), which receives data from the host and outputs an audio signal, and the synthesis system 600 on the DSP core (20) operate in parallel.

The synthesis system 600 receives data of two types from the host:

1) Diphones, which are made up of (compressed) frames containing L contiguous speech samples of a pitch period (T0).
2) Prosody scripts, which include all the prosodic information. Prosody scripts vary in length according to the number of frames to synthesize.

The host Interface 610 accepts data packets from the host, determines their type (i.e. whether it is frame or prosody script) and dispatches them to the decompression module 620.

The decompression module 620 reads compressed frames and prosody scripts, applies the decompression algorithm and stores the decompressed data into the corresponding buffer (i.e. the script buffer 641 and the frame buffer 642).

The decoding process (the decompressing process) is preferably implemented as follows. First, the compressed values of a frame are bit-shifted using a single shift value for each frame to compensate for the quantization scaling. Then two accumulations (i.e. successive additions of sequence samples) are applied: one over the frames and one inside each frame. One accumulation is done to undo the frame prediction (310 of FIG. 3) only for voiced sounds, and the other accumulation is done due to the difference process in the compression stage (320 of FIG. 3).

The computation cost of the decoding method is thus two fixed-point additions and one bit-shifting per sample. This is much less processing than is required for the average of 4.9 (possibly floating point) operations per sample reported in A Simple and Efficient Algorithm for the Compression of MBROLA Segment Database, O. Van Der Verken et al., in Proceedings of the Eurospeech 97, Patras, pp. 241–245. The overlap-add processing in the overlap-add module 630 loops through the prosody script entries sent by the host.

The prosodic information contained in the scripts includes:

1) Shift; Amount by which to shift the data out to the signal buffer after the overlap-add. Shifted samples are stored in the signal buffer 645. When the synthesis engine (150 of FIG. 1) is implemented on the DSP system 100 of FIG. 5, they are then read by DSP core (20).
2) Interpolation data; The interpolation data indicates where the phone boundary occurs and the interpolation depth (the number of frames on each side of the diphone boundary for which the interpolation has to be calculated).
3) Frame reverse flag; Repeated unvoiced frames are time-reversed by the overlap-add module 630.

Figure 7:
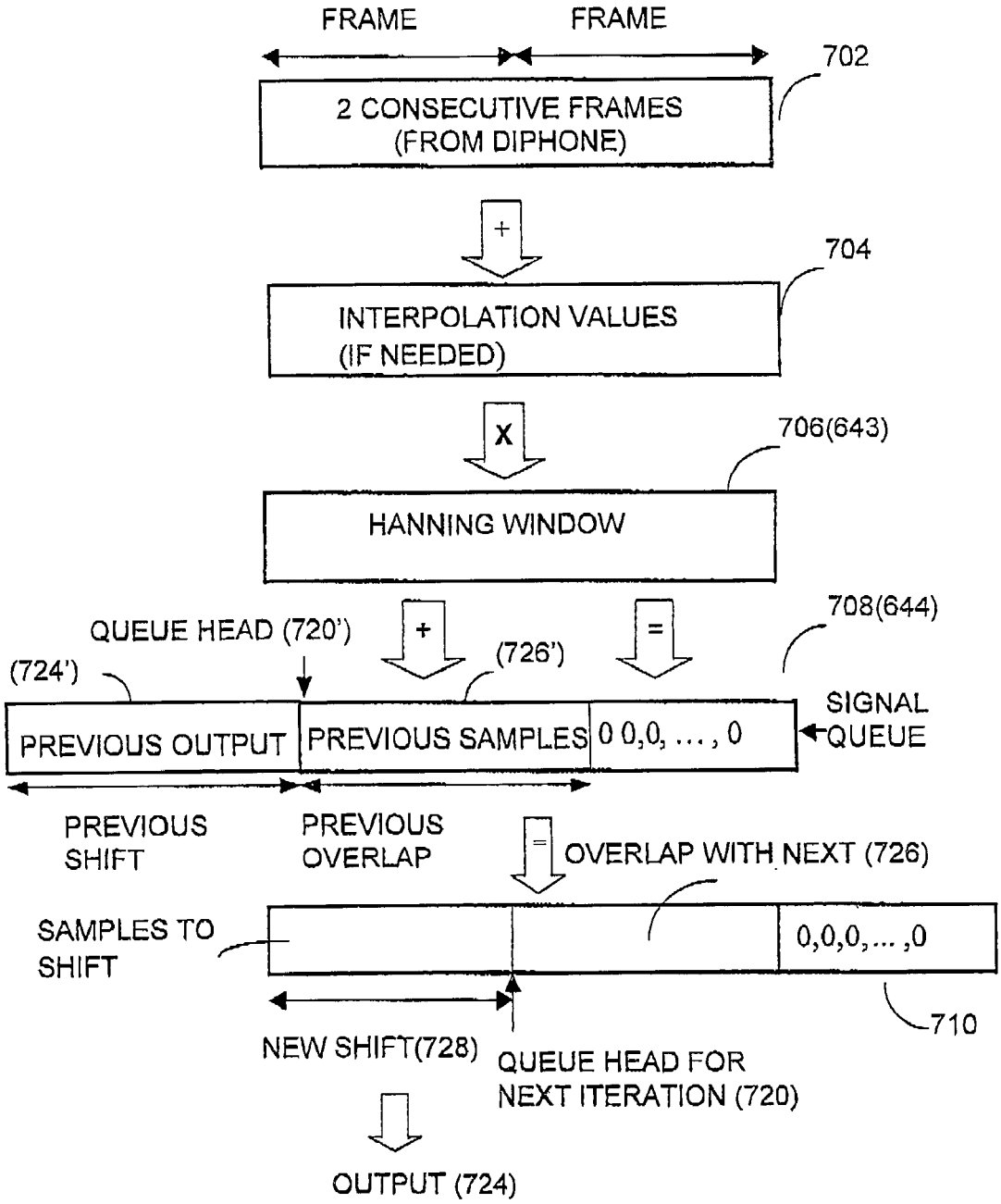
FIG. 7 is a schematic diagram showing the operation of the overlapadd module of FIG. 6.

FIG. 7 is a schematic diagram showing the operation of the overlapadd module 630. For each script entry, the overlap-add module 630 performs the following operations;

In step 702, build a 2L-sample frame from the L-sample frame referenced by the script and the L-sample frame that follows. If necessary, reverse the frame:

In step 704, calculate the interpolation values at the unit boundaries: If necessary, add the interpolation values to these L sample:

In step 706, apply a time-window (e.g. Hanning, Hamming, Blackman):

In step 708, overlap-add the 2L-sample frame at the beginning of the output signal queue (queue head 720): Previous output (724) and previous samples (726) are overlapped and added to the windowed data.

In step 710, shift out the number of values specified in the script (728); K bits of data are sampled and are outputs (724). J bits of data are used for OLA for next iteration (726Û 726). Then, adjust the signal queue pointer (720Û 720).

Interpolation between frames is applied at diphone boundary. In order to allow the data to flow through the system in real-time, an interpolation flag is inserted in the script at the frame where interpolation should start. For example, assume that two adjacent diphones have N and M frames respectively and that interpolation should occur over K frames on each side of the boundary. The first frame for which interpolation should occur is frame N−K of the first diphone. The value K is therefore inserted in the script entry for frame N−K, indicating that interpolation occurs over the next 2K frames.

When the overlap-add module (630) encounters a script entry containing the interpolation flag, it first waits until the next K frames are stored in the frame buffer (642 of FIG. 6). It then calculates the difference between frame N of the current diphone and frame 1 of the next diphone. This difference divided by K becomes the interpolation increment. This increment is added once to frame N−K of the first diphone, twice to frame N−K+1, three times to frame N−K+2, and so on. It is also applied −K times to the first frame of the second diphone, −K+1 to the second frame, −K+2 to the third frame, and so on.

Figure 8:
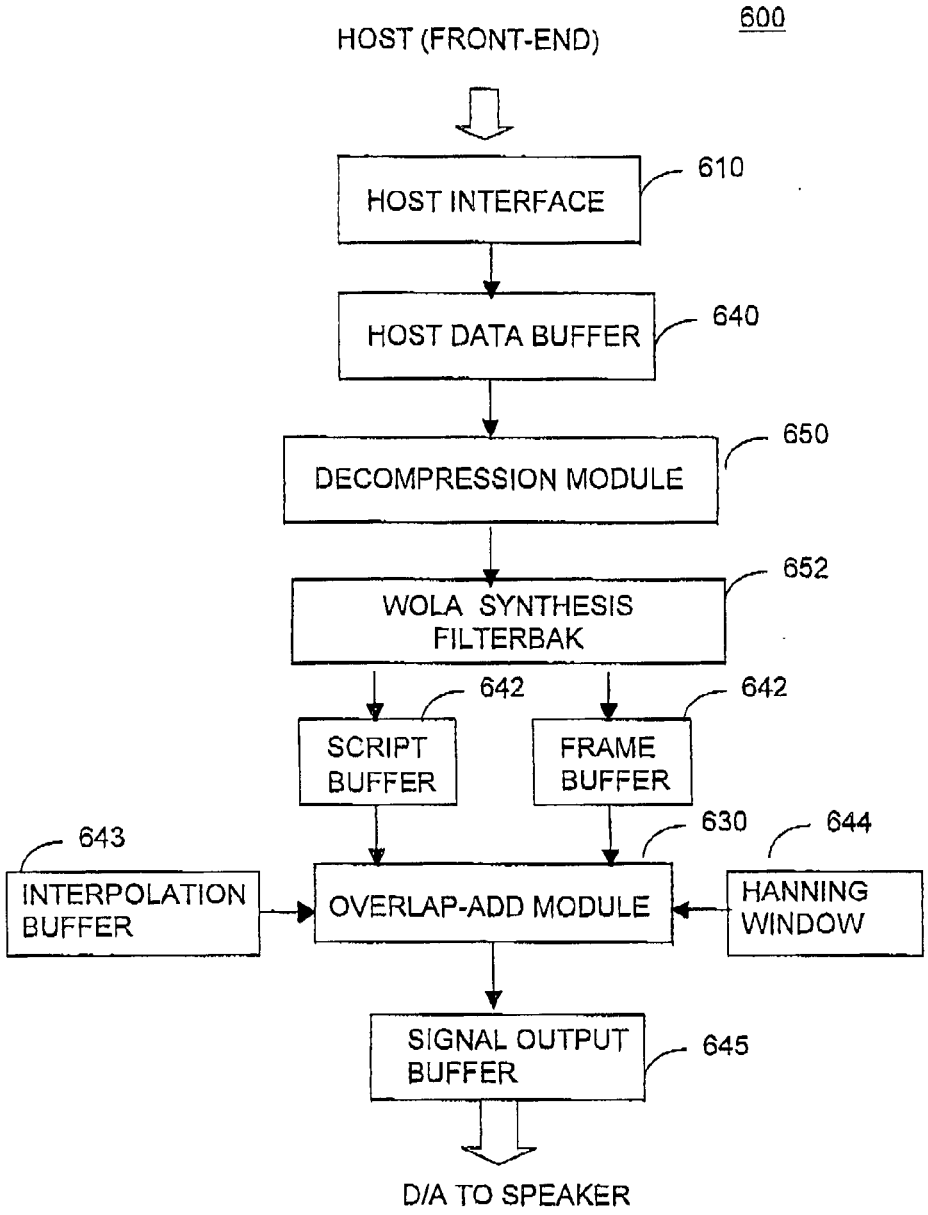
FIG. 8 is a block diagram showing another example of the synthesis system of the synthesis engine of FIG. 1.

FIG. 8 is a block diagram showing another example of the synthesis system 600. The synthesis system 600 of FIG. 8 includes a frequency decompression module 650 and the WOLA synthesis filterbank 652. The WOLA synthesis filterbank 652 is similar to the WOLA synthesis filterbank 84 of FIG. 12. The frequency decompression module decompresses incoming compressed data. The WOLA synthesis filterbank 652 converts the speech unit data from the frequency domain to time-domain.

When the speech unit database (110 of FIG. 1) is compressed in time-domain, the decompression module 620 of FIG. 6 is used. When the speech unit database (110) is compressed in frequency-domain, the frequency decompression module 650 and the WOLA synthesis filterbank 652 are used A further example of the synthesis engine (150 of FIG. 1) using a circular shift pitch synchronous overlap-add (CS-PSOLA) is next described. The synthesis method of the CS-PSOLA is based on the circular shifting of the normalized speech frames.

The CS-PSOLA in time-domain can allow the same processes to be repeated at periodic time-slots. This method is simple enough for a low-resource implementation. Furthermore, as will be shown, it offers a better mapping to the signal processing architecture of FIG. 5.

Assume that the speech units are normalized to a constant nominal pitch and a fixed phase by the MBR-PSOLA approach or the approach according to the embodiment of the present invention. The time-synthesis starts with a fixed-shift WOLA, instead of the variable-shift WOLA. The amount of the fixed time-shift is a small fraction (around 20%) of the nominal pitch period to preserve the continuity. Frames are repeated as needed to preserve the time-duration of the signal. To produce the desired pitch period, each frame (of a constant pitch period) is circularly shifted (rotated) forward in time. The amount of the circular shift is adjusted so that the two consecutive frames make a periodic signal with the desired pitch period. If the desired forward rotation is more than the frame length, the frame is rotated backward instead to align it with the previous frame.

The following pseudo-code summarizes the shift adjustment algorithm. In the following code, SHIFT represents the constant frame shift in the WOLA process, ROT_PREV is the amount of circular shift of the previous frame, PITCH is the desired pitch period, FRM_LEN is the frame length, and ROT is the desired rotation, all in samples.

```
ROT=PITCH (SHIFT ROT_PREV)
IF(ROT>FRM_LEN|ROT<FRM_LEN)
   ROT=(SHIFT ROT_PREV)
ROTATE FRAME BY ROT SAMPLES.
ROT_PREV=ROT
```

The rotated frames are then processed by a fixed-shift WOLA to produce periodic waveforms at the desired pitch. Other circular shift strategies are also possible.

Figures 9A, 9B, 9C:
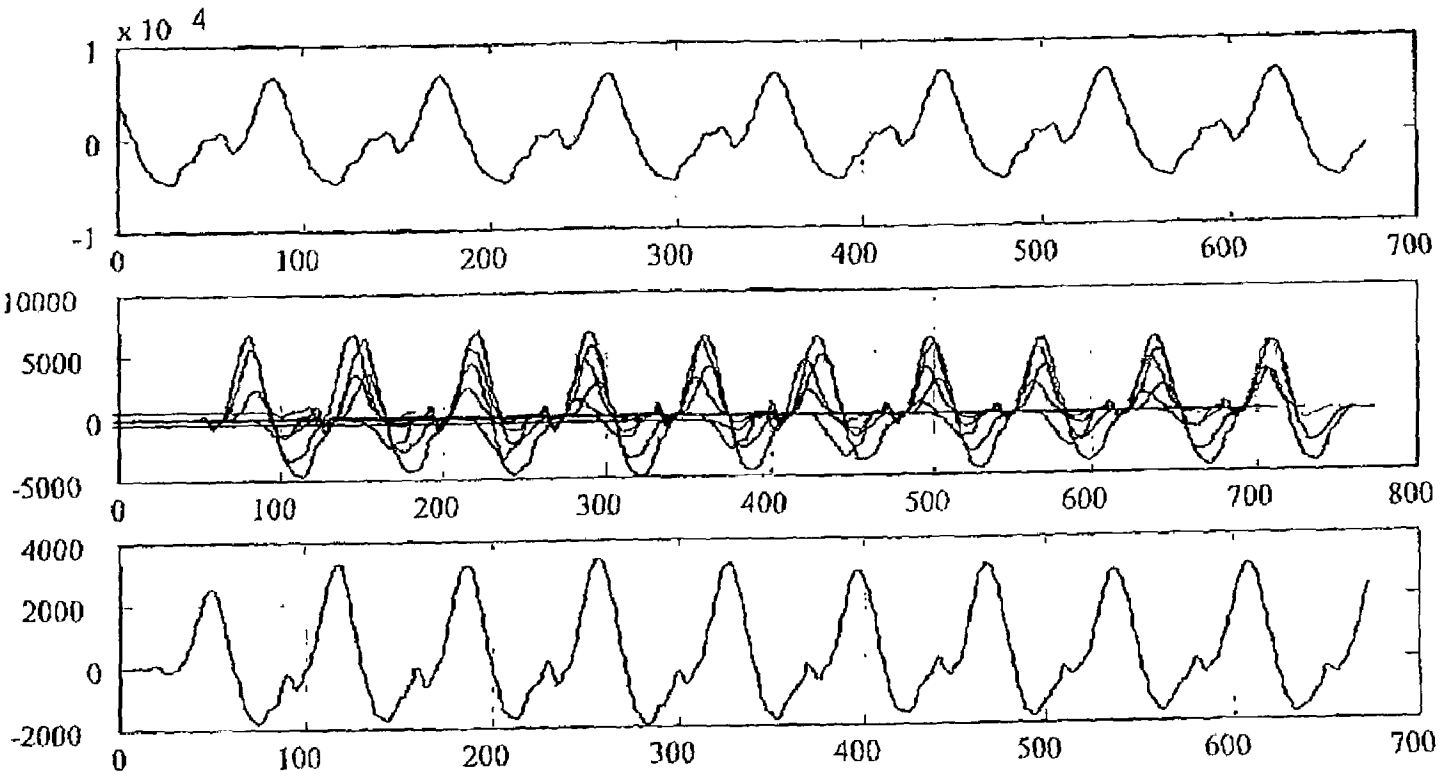
FIG. 9A is a timing diagram showing one example of the time-segment of a vowel.
FIG. 9B is a timing diagram showing rotated windowed overlapping frames of FIG. 9A.
FIG. 9C is a timing diagram showing the output of a CS-PSOLA module.

FIGS. 9A to 9C are timing diagrams showing signals for the OLA operation. FIG. 9A illustrates the time-segment of a vowel. FIG. 9B illustrates rotated windowed overlapping frames. FIG. 9C illustrates the output of a CS-PSOLA module. The pitch period is modified from 90 to 70 samples. The circular shift applied to the unvoiced sounds results in a randomisation of the waveform and prevents the periodic artefacts due to the WOLA synthesis.

A hardware implementation of the CS-PSOLA is described. The CS-PSOLA described above provides a convenient method of adjusting pitch in a frequency-domain processing architecture that utilizes an oversampled WOLA filterbank (e.g. 80 of FIG. 12) described above. The oversampled WOLA filterbank can also simultaneously be used to decompress the speech units prior to real-time synthesis.

Without loss of generality, the compressed speech frames of the units are read from the compressed-normalized speech database 130 of FIG. 1 in a frequency domain form and supplied to the CS-PSOLA module.

There are two possible methods to efficiently map the CS-PSOLA and simultaneous decompression to the signal processing architecture of FIG. 5. One is time-domain CS-PSOLA and the other is frequency-domain CS-PSOLA.

The CS-PSOLA algorithm can be efficiently implemented on the WOLA filterbank 10 of FIG. 5. Unit decompression can be implemented either in the time-domain using the DSP core 20 of FIG. 5 or in the frequency domain potentially using the WOLA synthesis filterbank (e.g. 84 of FIG. 12). The compressed speech frames of the units are read from the compressed-normalized speech database (130 of FIG. 1) in a frequency domain form.

Figure 10:
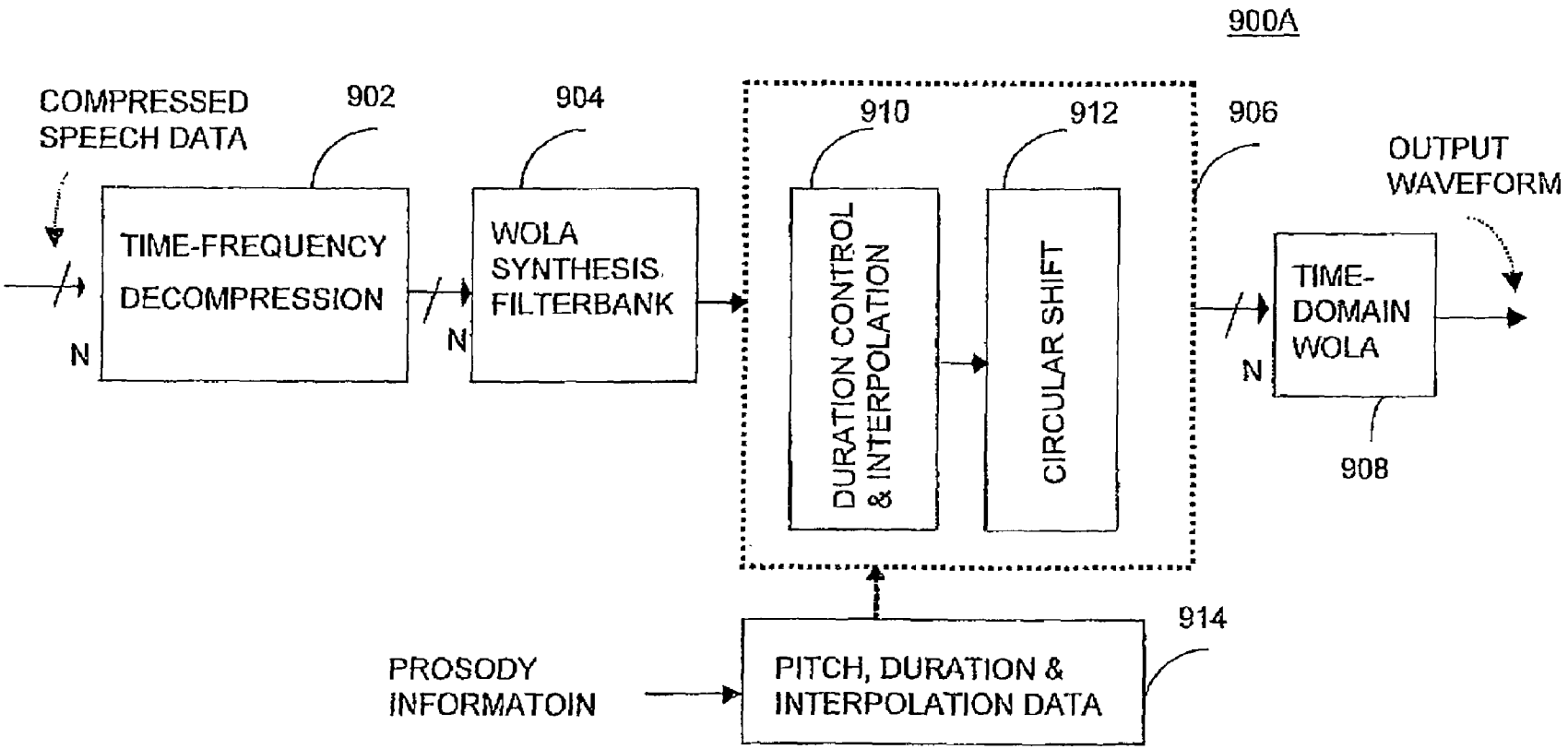
FIG. 10 is a block diagram showing one example of a time-domain implementation of the CS-PSOLA module.

Time-domain CS-PSOLA is described. FIG. 10 is a block diagram showing one example of a time-domain implementation of the CS-PSOLA The CS-PSOLA module 900A of FIG. 10 has a time-frequency decompression module 902, a WOLA synthesis filterbank 904, a processing module 906 and a time-domain WOLA module 908. The processing module 906 includes a duration control and interpolation module 910 and a circular shift module 912. The WOLA synthesis filterbank 904 is similar to the WOLA synthesis filterbank 84 of FIG. 12. Prosodic information received from the host includes pitch, duration and interpolation data that are stored (914) When the CS-PSOLA module 900A is implemented on the DSP system 100 of FIG. 5, time-domain operation (i.e. the processing module 906 and the time-domain WOLA module 908) are implemented on the DSP core (20 of FIG. 5).

The CS-PSOLA module 900A receives frequency-domain speech units from the compressed-normalized speech database (130 of FIG. 1). The time-frequency decompression module 902 decompresses incoming signals based on an employed time-frequency compression method discussed above. Many classes of optimal/adaptive algorithms can be applicable.

After data decompression, the WOLA synthesis filterbank 904 converts a frame of one pitch period from the frequency domain to the time domain.

Then, based on prosodic information (914), time-interpolation and duration control 910 and the circular shift 912 are applied to the frame. The circular shift 912 is implemented based on the code described above. Finally, a fixed-shift WOLA module 906 synthesizes the output speech. The CS-PSOLA module 900A can employ the WOLA synthesis filterbank 904 to implement frequency decompression techniques such as the one described in An Ultra Low-Power Miniature Speech CODEC at 8 kb/s and 16 kb/s, R. Brennan et al., in Proceedings of the ICSPAT 2000, Dallas, Tex.

Figure 11:
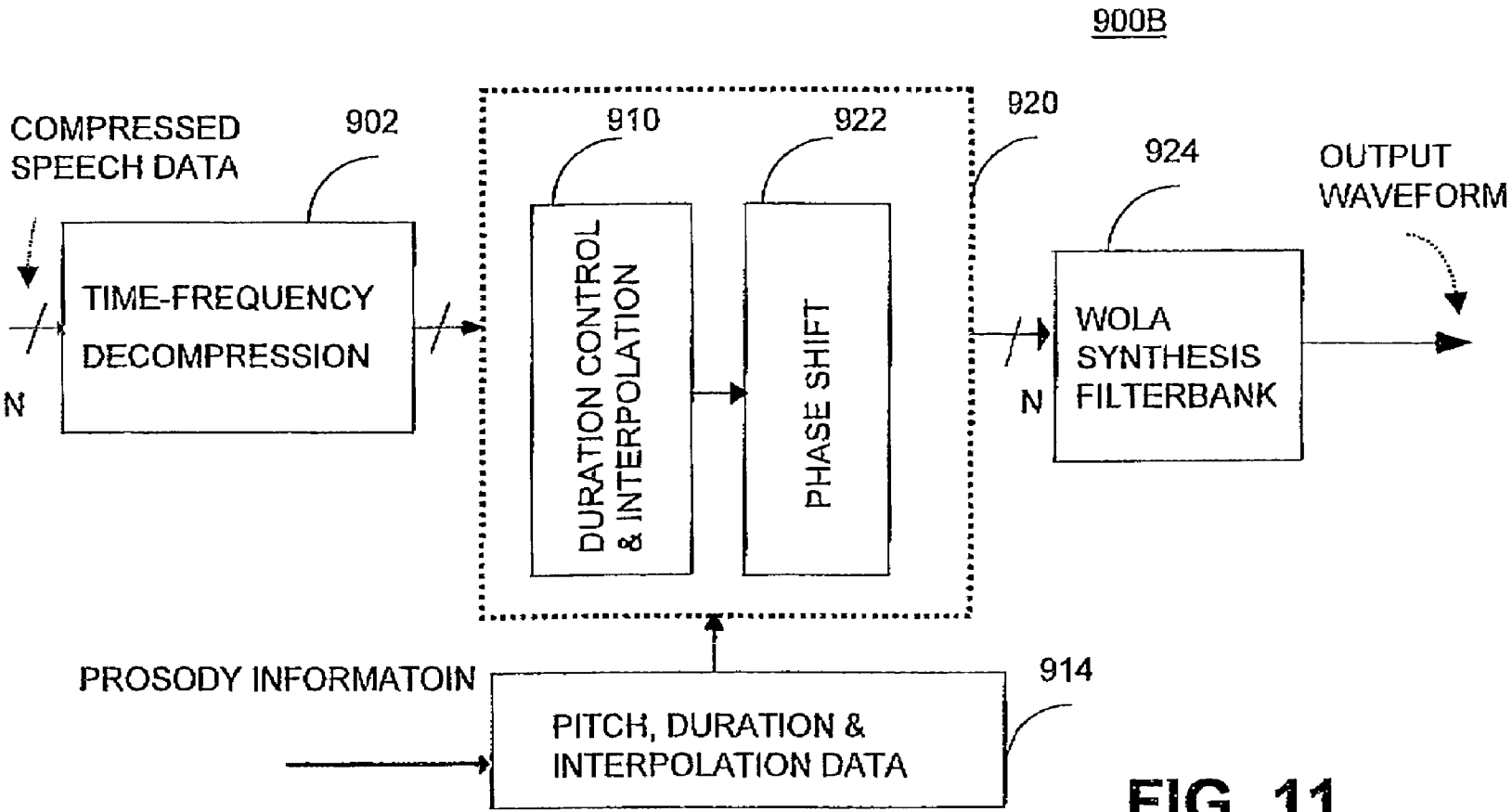
FIG. 11 is a block diagram showing another example of a frequency-domain implementation of the CS-PSOLA module.

The CS-PSOLA in the frequency-domain is described FIG. 11 is a block diagram showing one example of a frequency-domain implementation of the CS-PSOLA. The CS-PSOLA module 900B has the time-frequency decompression module 902, a processing module 920 including the duration control and interpolation module 910 and a phase shift module 922, and a WOLA synthesis filterbank 924. The WOLA synthesis filterbank 924 is similar to the WOLA synthesis filterbank 84 of FIG. 12. Prosodic information received from the host includes pitch, duration and interpolation data that are stored (914).

The CS-PSOLA module 900B receives frequency-domain speech units from the compressed-normalized database (130 of FIG. 1). The time-frequency decompression module 902 decompresses incoming signals. Then, a circular shift is implemented in frequency domain through a linear phase shift in the phase shift module 922. Since the nominal pitch frequency in the normalization, process is arbitrary, one can constrain it to be a power of two to be able to use the Fast Fourier Transform (FFT).

For example, at 16 kHz sampling rate, a nominal pitch period of 128 samples gives an acceptable pitch frequency of 125 Hz. Since the method of pitch modification is equivalent to a circular shift in time-domain, it is distinct from the class of frequency-domain PSOLA (FD-PSOLA) techniques that directly modify the spectral fine structure to change the pitch.

After decompression, linear phase-shift and interpolation can be applied directly in frequency domain in the duration control and interpolation module 910 and the phase shift module 922. The results are further processed by a fixed-shift WOLA synthesis filterbank 924 to obtain the output waveform.

Bandwidth extension of speech using the oversampled WOLA filterbank is described. Bandwidth Extension (BWE) is an approach to recover missing low and high frequency component of speech and can be employed to improve speech quality There are many BWE methods proposed for coding applications (for example, An upper band on the quality of artificial bandwidth extension of narrowband speech signal, P. Jax, and P. Vary, Proceedings of the ICASSP 2002, pp. 1–237–240 and the references provided there).

When frequency-domain BWE is used, the oversampled WOLA filterbank can be employed to re-synthesize the bandwidth extend speech in time-domain.

On the off-line, bandwidth extension module for performing BWE may be provided after the speech unit database (110 of FIG. 1) such that BWE is applied to data read from the speech unit database (110).

On the on-line, the bandwidth extension module may be provided after the decompression module (620 of FIG. 6, 650 and 652 of FIG. 8) and prior to the overlap-add module (630 of FIGS. 6 and 8).

On the on-line, the bandwidth extension module may be provided after the prosodic normalization.

The application is not limited to speech synthesis. In the particular case of speech synthesis, BWE will increase the speech quality and will decrease artefacts.

According to the embodiment of the present invention, a synthesis system and method can provide a reasonably good quality audio signal corresponding to input text. The method can be implemented on the DSP system including the WOLA filterbank, the DSP core and the input-output processor (10, 20 and 30 of FIG. 5). The synthesis engine (150 of FIG. 1) which is implemented on the DSP system has the following characteristics: 1) Low memory usage; 2) Low computation load and complexity; 3) Low processing time for the synthesis; 4) Low communication bandwidth between the unit database and the synthesis engine (which results in low power); 5) A proper task partitioning of necessary processing that can be implemented in embedded systems; 6) A simplified implementation of prosodic manipulation; 7) Easily adjustable pitch variation that provides high quality.

The DSP system 100 of FIG. 5 can implement purely time-domain processing as well as mixed time-frequency domain processing, and purely frequency domain processing.

The normalized unit is compressed by using advanced time-frequency data compression techniques on an efficient platform in conjunction with CS-PSOLA system.

The compressed speech unit database is decompressed efficiently by the WOLA filterbank and the DSP core using time-domain or time-frequency domain tourniquets.

The speech unit data compression leads to a decompression technique on the DSP core achieving a reasonable compression ratio and at the same time maintaining the decoder simplicity to a minimum degree.

The CS-PSOLA and its time and frequency domain implementations on the oversampled WOLA filterbank can simplify the process of prosodic normalization on the DSP core and the WOLA filterbank.

The interpolation is efficiently implemented for time-domain and frequency-domain methods on the WOLA filterbank and the DSP core.

The time-domain implementation of the CS-PSOLA synthesis makes it possible to directly take advantage of the advanced time-frequency compression techniques, including those that use psychoacoustic techniques. An example is described in An Ultra Low-Power Miniature Speech CODEC at 8 kb/s and 16 kb/s (R. Brennan et al., in Proceedings of the ICSPAT 2000, Dalas, Tex.). It describes a typical subband coder/decoder implementation on the platform.

The frequency-domain CS-PSOLA provides computationally efficient prosodic normalization and time-synthesis.

The oversampled WOLA filterbank used for the speech synthesis and data decompression provides Very low group delay; A flexible power versus group delay trade-off; Highly isolated frequency bands; and Extreme band gain adjustments.

While the present invention has been described with reference to specific embodiments, the description is illustrative of the invention and is not to be construed as limiting the invention. Various modifications may occur to those skilled in the art without departing from the scope of the invention as defined by the claims.

What is claimed is:

1. A system for synthesizing audio signals that receives the text as input, analyses the text to find the speech unit labels and prosody parameters to provide speech units which are possibly compressed and prosody scripts which are possibly compressed, the system comprising:

a decompression module for decompressing speech units and prosody scripts; and an overlap-add module for synthesizing speech using the speech units based on the prosody scripts.

2. The system as claimed in claim 1, further comprising an interface module for interfacing a host to receive compressed speech units and compressed prosody parameters which are supplied to the decompression module, the host analysing the input text to supply the speech units and the related prosody parameters to the on-line processing module.

3. The system as claimed in claim 1, wherein the on-line processing module further includes an input-output processor for receiving the speech units and the related prosody parameters and outputting speech signals, the on-line processing module is implemented on a digital signal processing system including the input-output processor and a reprogrammable digital signal processing (DSP) core, which operate in parallel.

4. The system as claimed in claim 1, wherein the speech units are compressed by a block-adaptive differential code modulation (ADPCM).

5. The system as claimed in claim 4, wherein the speech units are compressed by a block-adaptive differential pulse code modulation (ADPCM) with a scale factor which is a power of two.

6. The system as claimed in claim 4, wherein the decompression module includes a scaling module for scaling the compressed values of a frame to compensate for quantization scaling and an accumulation module for implementing accumulation over the frames and implementing accumulation inside each frame.

7. The system as claimed in claim 4, wherein the decompression module includes a bit shift module for bit-shifting the compressed values of a frame to compensate for quantization scaling and an accumulation module for implementing accumulation over the frames and implementing accumulation inside each frame.

8. The system as claimed in claim 1, wherein the on-line processing module employs the re-harmonized speech units and the prosody parameters to synthesize speech sounds and the on-line processing module further includes a module for implementing time-domain interpolation, prosodic normalization, time-domain synthesis and digital/analog (D/A) process to generate speech signal.

9. The system as claimed in claim 1, wherein the on-line processing module employs the re-harmonized speech units and the prosody parameters to synthesize speech sounds and the on-line processing module further includes a module for implementing time-domain interpolation, prosodic normalization, time-domain synthesis and digital/analog (D/A) process to generate speech signal, the compressed speech frames and related prosody parameters are decompressed on-line by the decompression module and are supplied to the module.

10. The system as claimed in claim 3, wherein the prosody parameter includes a shift by which data obtained after the overlap-add is shifted.

11. The system as claimed in claim 3, wherein the prosody parameter includes interpolation data for interpolating data.

12. The system as claimed in claim 1, wherein the overlap-add module implements a circular-shift pitch-synchronous overlap-add (CS-PSOLA) procedure.

13. The system as claimed in claim 12, wherein the CS-PSOLA carries out circular-shift to change a pitch in the time-domain for a fixed-shift WOLA.

14. The system as claimed in claim 1, wherein the host generates constant-pitch speech frames of length two or more pitch periods off-line to supply to the on-line processing module.

15. The system as claimed in claim 1, wherein the on-line processing module further includes a module for applying bandwidth extension (BWE) to the output of the decompression module to recover frequency components.

16. The system as claimed in claim 8, wherein the on-line processing module further includes a module for applying bandwidth extension (BWE) to speech signals obtained after the prosody normalization.

17. A system for processing speech units, the system comprising:

an offline compression module for compressing re-harmonized speech units; and an on-line frequency-domain decompression module having an oversampled synthesis filterbank for decompressing the compressed speech units.

18. The system as claimed in claim 17, wherein the off-line compression module employs a time-domain compression and a frequency-domain compression to compress the re-harmonized speech units.

19. The system as claimed in claim 18, wherein the off-line compression module includes a block-adaptive differential code modulation (ADPCM) module in time-domain compression, and the decompression module includes the time-domain decompression module for decompressing the speech units having a scaling module to scale the compressed values of a frame to compensate for quantization scaling and an accumulation module for implementing accumulation over the frames and implementing accumulation inside each frame.

20. The system as claimed in claim 18, wherein the off-line compression module includes an oversampled WOLA filterbank for implementing the frequency-domain compression.

21. The system as claimed in claim 15 further comprising a speech unit database for recording speech and a module for applying bandwidth extension (BWE) to data of the speech unit database to recover frequency components.

22. The system as claimed in claim 15 further comprising on-line module for applying bandwidth extension (BWE) to the output of the decompression module to recover frequency components.

23. A system for synthesizing audio signal, comprising:

a decompression module for decompressing speech units, the speech unit including a frame of a constant pitch period;

a circular shift pitch synchronous overlap-add (CS-PSOLA) module including a fixed-shift weighted overlap-add module for implementing a weighted overlap-add of the decompressed data, the circular shift pitch synchronous overlap-add module shifting the frame so that two consecutive frames make a periodic signal with a desired pitch period.

24. The system as claimed in claim 23, wherein the decompression module and the CS-PSOLA module are implemented on a digital signal processing system including an oversampled WOLA filterbank and a DSP core, which operate in parallel.

25. The system as claimed in claim 23, further comprising an input-output processor for receiving data and outputting synthesis result, wherein the input-output processor, the decompression module and the CS-PSOLA module are implemented on a digital signal processing system including the input-output processor, an oversampled WOLA filterbank and a DSP core, which operate in parallel.

26. The system as claimed in claim 24, wherein the CS-PSOLA module operates in time-domain, and the CS-PSOLA module includes a WOLA synthesis filterbank, a circular shift module and a time-domain, fixed-shift weighed overlap-add module.

27. The system as claimed in claim 24, wherein the CS-PSOLA module operates in frequency-domain, and the CS-PSOLA module includes a phase shift module and a fixed-shift weighed overlap-add module.

28. The system as claimed in claim 23 further comprising on-line module for applying bandwidth extension (BWE) to the output of the decompression module to recover frequency components.

29. A system for synthesizing audio signals, the system comprising:

an on-line processing module including;

an interface for interfacing a host to receive compressed speech units and related compressed prosody parameters;

a decompression module for decompressing data received on the interface; and an overlap-add module for synthesizing speech units using the speech units based on the related prosody parameters, the receipt of data from the host, decompression and speech synthesis are carried out in parallel, substantially in real-time.

30. The system as claimed in claim 29, wherein the interface includes an input-output processor for receiving the speech units and the prosody parameters and outputting the synthesis result, the on-line processing module is implemented on a digital signal processing system including the input-output processor and a re-programmable DSP core, which operate in parallel.

31. The system as claimed in claim 29, wherein the decompression module includes an oversampled, WOLA synthesis filterbank for implementing decompression of the speech units in frequency-domain.

32. The system as claimed in claim 29, wherein the speech units are compressed by a block-adaptive differential code modulation (ADPCM) and the decompression module having a scaling module to scale the compressed values of a frame to compensate for quantization scaling and an accumulation module for implementing accumulation over the frames and implementing accumulation inside each frame.

33. A system for speech unit re-harmonization, the system comprising:

an off-line module and an on-line module, the off-line module including;

a normalizing module including a module for generating constant-pitch speech frames of more than one pitch period;

a compression module for compressing the output of the normalizing module, and a database for recording the output of the compression module, the on-line module including;

an interface for interfacing the off-line module for receiving data from the database;

a decompression module for decompressing data received on the interface; and a speech engine for synthesizing speech using the output of the decompression module.

34. The system as claimed in claim 33, wherein the on-line module is implemented on a digital signal processing system including a input-output processor for the interface and a re-programmable DSP core, which operate in parallel.

35. The system as claimed in claim 33, wherein the compression module includes an oversampled WOLA filterbank for compressing data.

36. The system as claimed in claim 33, wherein the decompression module includes an oversampled WOLA synthesis filterbank for decompressing data.

37. The system as claimed in claim 33, wherein the compression module employs a time-domain compression module and a frequency-domain compression.

38. The system as claimed in claim 33, wherein the off-line module further includes a speech unit database for recording speech and a module for applying bandwidth extension (BWE) to data of the speech unit database to recover frequency components.

39. The system as claimed in claim 33, wherein the on-line processing module further includes a module for applying bandwidth extension (BWE) to speech signals obtained after the prosodic normalization.

40. A method of synthesizing audio signals on a system that receives the text as input, analyses the text to find the speech unit labels and prosody parameters to provide speech units which are possibly compressed and prosody scripts which are possibly compressed, the method comprising the steps of:

decompressing speech units and prosody scripts, and performing overlap-add synthesizing speech using the speech units based on the prosody scripts.

41. A method as claimed in claim 40, further comprising the step of receiving compressed speech units and prosody parameters.

42. A method as claimed in claim 40, wherein the receiving step, the decompressing step and the overlap-add step run in parallel.

43. A method as claimed in claim 40, wherein the decompressing step decompresses data which is compressed by a block-adaptive differential code modulation (ADPCM), the decompressing step includes the step of scaling to scale the compressed values of a frame to compensate for quantization scaling and the step of implementing accumulation over the frames and implementing accumulation inside each frame.

44. A method as claimed in claim 40, wherein the decompressing step decompresses data using an oversampled WOLA synthesis filterbank.

45. A method as claimed in claim 40, wherein the overlap-adding step includes the step of implementing interpolation.

46. A method as claimed in claim 40, wherein the overlap-adding step includes the step of applying a time-window before implementing overlap-add process.

47. A method as claimed in claim 40, further comprising the step of performing bandwidth extension (BWE) to data obtained by the decompressing step.

48. A method of synthesizing speech comprising the steps of:

decompressing data regarding to speech units, the speech unit including at least one frame of a constant pitch period; and implementing a circular shift pitch synchronous overlap-add (CS-PSOLA), the CA-PSOLA step including the step of a fixed-shift weighted overlap-adding to applying a weighted, overlap-add process to the decompressed data, the step of the CS-PSOLA shifting the frame so that two consecutive frames make a periodic signal with a desired pitch period.

49. A method as claimed in claim 48, wherein the decompressing step and the CS-PSOLA step are implemented on a digital signal processing system including an input/output processor, a oversampled, weighted overlap-add filterbank and a DSP core, which operate in parallel, thereby permitting the digital signal processing system substantially in real time.

50. A method as claimed in claim 48, further comprising the step of performing bandwidth extension (BWE) to data obtained by the decompressing step.

* * * * *